United States Patent [19]

Fales

[11] 4,270,878

[45] Jun. 2, 1981

[54] CORRUGATED DRAINAGE TUBING AND METHOD AND APPARATUS FOR MAKING DRAINAGE TUBING WITH HELICALLY ARRANGED DRAINAGE OPENINGS

[75] Inventor: David E. Fales, Springfield, Ill.

[73] Assignee: Rainer Isolierrohrfabrik Max Drossbach, Rain am Lech, Fed. Rep. of Germany

[21] Appl. No.: 5,448

[22] Filed: Jan. 22, 1979

Related U.S. Application Data

[62] Division of Ser. No. 838,367, Sep. 30, 1977, Pat. No. 4,163,619.

[51] Int. Cl.[3] ..... B23D 5/00; B26D 3/00; B23B 5/00

[52] U.S. Cl. ..... 409/143; 82/82; 83/54; 83/187; 409/228; 409/307

[58] Field of Search ..... 82/82, 20; 409/143, 409/228, 306, 307; 83/54, 187

[56] References Cited

U.S. PATENT DOCUMENTS

| | | | |
|---|---|---|---|
| 1,311,584 | 7/1919 | Allgrunn | 409/306 |
| 1,382,939 | 6/1921 | Spade | 409/306 |
| 1,536,433 | 5/1925 | Hartman | 82/82 |
| 1,796,448 | 3/1931 | Gere . | |
| 1,884,143 | 10/1932 | Norquist . | |
| 2,210,849 | 8/1940 | Bohle | 409/306 |
| 2,805,695 | 10/1957 | Hoheisel | 144/219 |
| 3,566,607 | 3/1971 | Sixt . | |
| 3,678,718 | 7/1972 | Brown et al. . | |
| 3,699,684 | 10/1972 | Sixt . . | |
| 3,709,095 | 1/1973 | Laumer | 409/143 |
| 3,768,365 | 10/1973 | Howe . | |
| 3,815,399 | 6/1974 | Foulks et al. . | |
| 3,820,340 | 6/1974 | Jenner . | |
| 3,824,886 | 7/1974 | Hegler . | |
| 3,830,373 | 8/1974 | Sixt . | |
| 3,868,876 | 3/1975 | Nordstrom | 82/20 |
| 4,128,927 | 2/1979 | Hamil | 409/307 |
| 4,158,534 | 6/1979 | Hegler | 83/54 |

*Primary Examiner*—Harrison L. Hinson

[57] ABSTRACT

A thermoplastic corrugated drainage tube comprising annular peaks and valleys and a plurality of drainage openings internally cut about the circumference of each valley, the openings in each valley aligned with the openings in successive valleys along helical lines described by said openings. The method of forming the drainage openings comprises placing a cutting tool in the interior of the tubing and rotating the tool while moving the tubing axially past the tool. The cutting tool comprises a body having a plurality of radially projecting cutters spaced equidistantly about the cutter body and means for rotating the tool.

9 Claims, 6 Drawing Figures

CORRUGATED DRAINAGE TUBING AND METHOD AND APPARATUS FOR MAKING DRAINAGE TUBING WITH HELICALLY ARRANGED DRAINAGE OPENINGS

This is a division, of application Ser. No. 838,367, filed Sept. 30, 1977, now U.S. Pat. No. 4,163,619.

This invention relates to thermoplastic drainage tubing comprising peaks and valleys having drainage openings internally cut in the bases of the valleys and to a method and apparatus for internally cutting the drainage openings in the tubing.

Drainage tubing of corrugated plastic having drainage openings in the bases of the annular, corrugation valleys is widely used, particularly in agriculture. The formation of the drainage openings, particularly if cut internally in a manner reducing the height of the corrugation walls, tends to weaken the tubing. Expedients to minimize this strength reduction include limiting the number of drainage openings in each valley or providing openings only in valleys spaced by unperforated valleys. Such expedients, however, tend to limit the open area provided by the drainage openings or provide an uneven distribution of the openings about the tubing circumference.

It is, accordingly, an object of the present invention to provide internally cut drainage tubing having a large open area provided by closely spaced drainage openings distributed about the circumference of the tubing which tubing is not significantly reduced in strength by the drainage openings. Another object of this invention is to provide a method and apparatus for cutting the drainage openings cleanly and accurately and in a manner which will provide a tubing meeting the objectives above mentioned.

In general, the invention features corrugated thermoplastic tubing having alternating peaks and valleys with drainage openings formed in the bases of the valleys. A plurality of spaced drainage openings is provided about the circumference of each valley and the openings are axially and circumferentially offset by tubing wall material from openings in successive valleys.

In a preferred embodiment the openings are equidistantly spaced and lie on helical lines defined by openings in successive valleys and each helical line from one opening crosses an axial line drawn from an adjacent opening at a distance from the latter comprising a plurality of valleys. The helical lines describe one revolution about the tubing surface in a lineal distance equal to from 4–12 times the tubing diameter, the helical lines at an angle to the tubing axis in the range of from about 14°–37°. In a preferred embodiment the helical lines describe one revolution in three feet to one meter for tubing up to 8 inches in diameter. In the described embodiment the wall height is reduced by internal cuts forming the openings.

The method of cutting the drainage openings comprises placing a cutting tool on the interior of the tubing, the tool having a plurality of cutters equidistantly spaced thereabout and projecting radially a distance sufficient to cut through the valley bases, and relatively axially and rotatively moving the cutting tool and the tubing to form the openings along helical lines. In a preferred embodiment the tubing is moved axially past the cutting tool and the tool is rotated, the tool being rotated at a speed relative to the speed of axial movement of the tubing cutting the openings on helices at an angle to the tubing axis in the range of about 14°–37°. The cutting tool is preferably rotated by frictional engagement with the tubing and the tubing is supported ahead of and behind the cutters as the openings are cut.

The cutting tool comprises a body adapted to fit within the tubing a plurality of radially projecting cutters, and means to rotate the body. In a preferred embodiment the cutting tool is rotatably mounted on a shaft and has a plurality of guides mounted on the body extending helically at an angle of 14°–37° to the axis over a distance equal to a plurality of tubing valleys, the guides projecting radially to engage the interior of said plurality of valleys whereby the tool is rotated by the engagement of the guides and the tubing as the tubing is moved axially. The guides may be biased outwardly and preferably have one edge projecting farther than the remainder of the guide, the one edge engaging the tubing. The body is preferably cylindrical and has low friction pads engaging and supporting the interior of the tubing ahead of the cutters; a stationary cylinder is also provided to support the tubing behind the cutters. A post is located behind the cutters to engage and support the tubing at the opening immediately behind the cutters as the cutter forms the next opening. The cutters have open ended hollow interiors to facilitate chip removal.

Other objects, features and advantages of this invention will be apparent to those skilled in the art from the following detailed description of a preferred embodiment thereof, taken together with the accompanying drawings in which.

Figure 1:
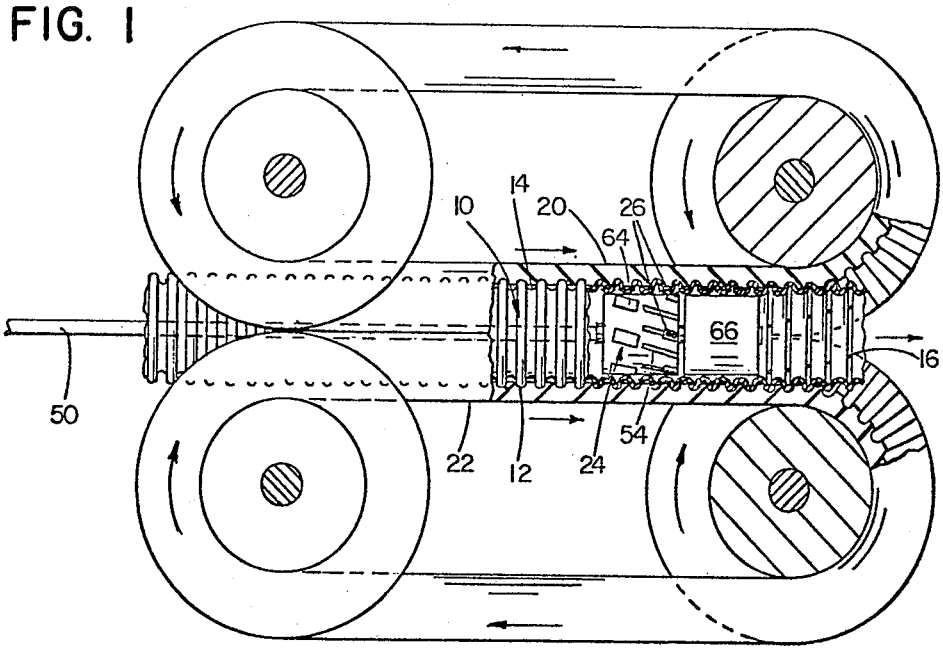
FIG. 1 is a side elevation, partly in section, of apparatus including a cutting tool for cutting the drainage openings in the illustrated corrugated tubing.
Figure 4:
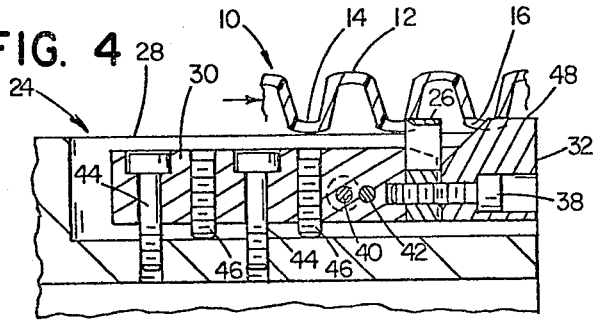
FIG. 4 is a developed sectional view taken along the line 4—4 of FIG. 2.
Figure 5:
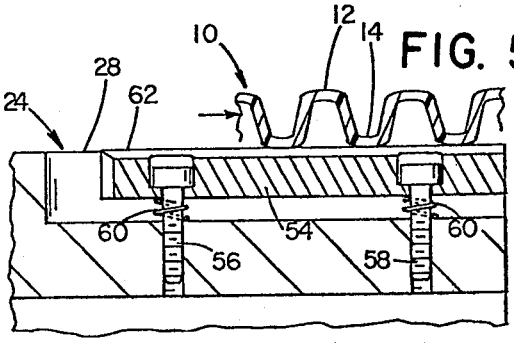
FIG. 5 is a developed sectional view taken along the line 5—5 of FIG. 2.
Figure 6:
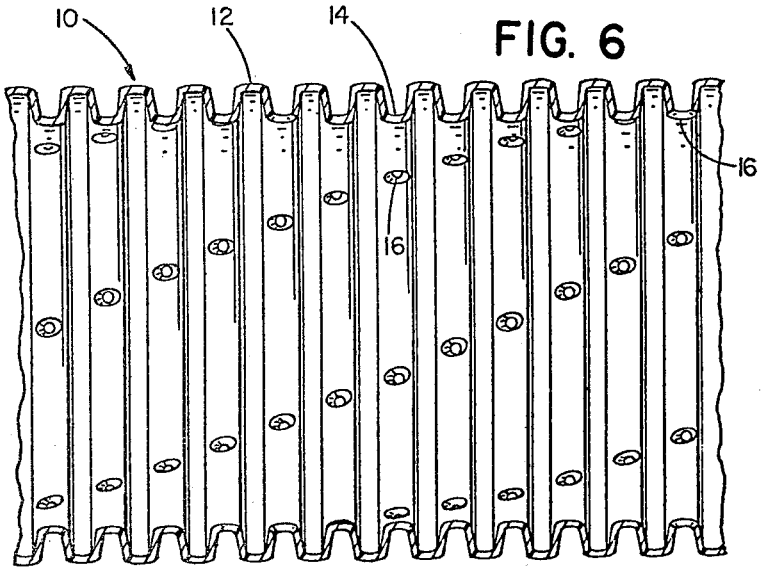
FIG. 6 is a reduced sectional view of tubing made according to the present invention.

As shown in FIG. 1, corrugated tubing 10, comprising alternate annular peaks 12 and valleys 14, is drawn by corrugated belts 20,22 through apparatus for internally cutting drainage openings 16 in the bases of the valleys 14. Belts 20,22 have the corrugations spaced from the bottoms of the tubing corrugations to avoid damage as drainage openings are cut. Alternatively, the belts may be uncorrugated. The apparatus includes a cutting tool 24 having a plurality, six in one embodiment, of cutters 26 equidistantly spaced thereabout and projecting radially outwardly to engage the valley bases and cut the drainage openings 16 as tubing 10 is drawn through the apparatus. As shown in FIGS. 4 and 6, the cutting of the drainage openings 16 reduces the height of the walls extending between the peaks 12 and valleys 14 of the tubing, a factor potentially contributing to weakening of the tubing.

To avoid significant weakening of the tubing, the openings are helically arranged along the tubing. This is accomplished by rotating the cutting tool 24 as the tubing 10 is drawn axially through the cutting apparatus. For tubing having a range of diameters from 3–8 inches and employing six cutters 26, the tool 24 is rotated once over a linear distance of about three feet or one meter of tubing length, i.e., a distance in the range of about 4–12 times the tubing diameter as the tubing is moved past the cutting tool 24. The angle of the helix to the tubing axis is preferably in the range of about 14°–37°.

Figure 2:
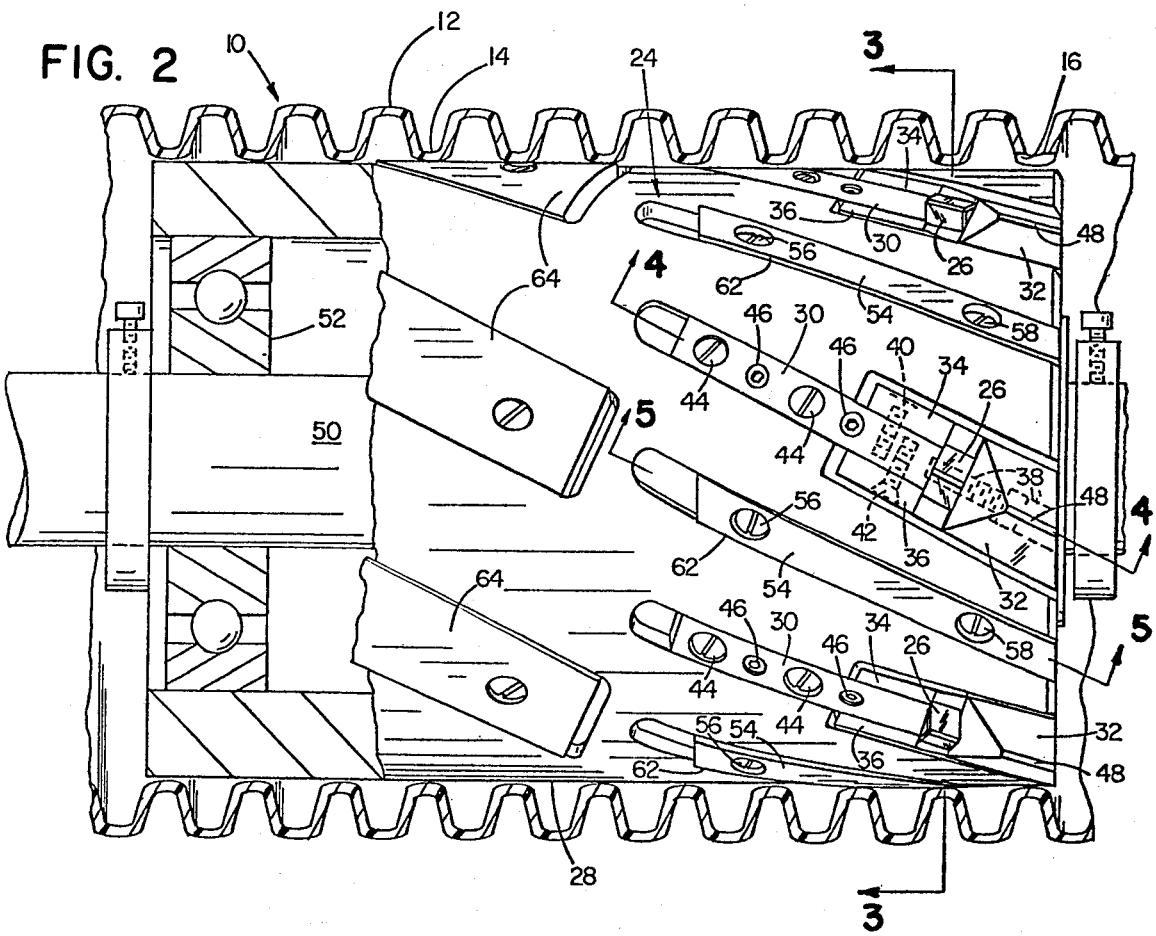
FIG. 2 is an enlarged side elevation partly in section of the cutting tool and the tubing illustrated in FIG. 1.
Figure 3:
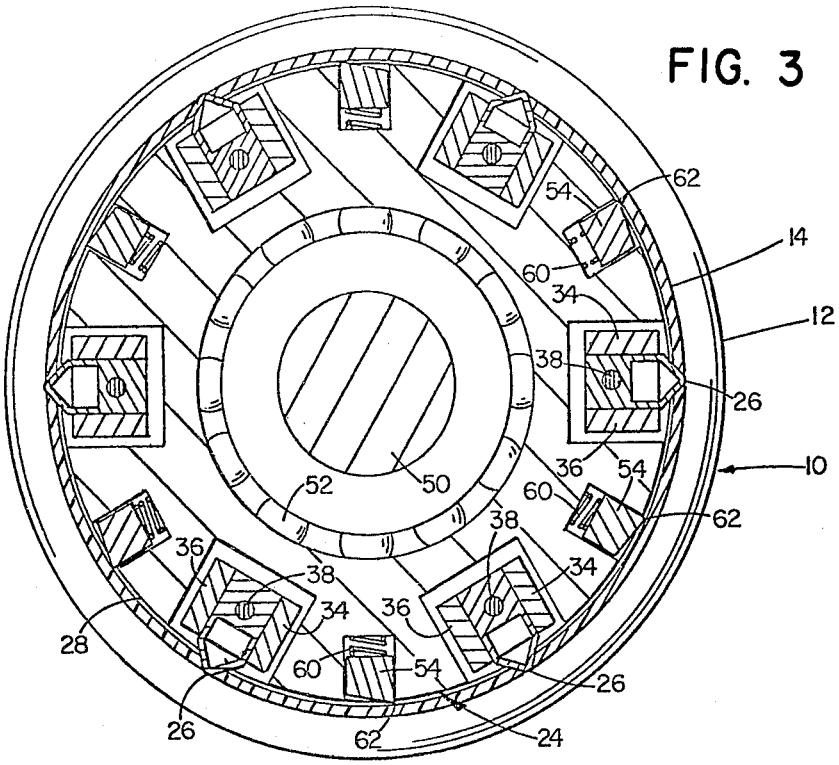
FIG. 3 is a sectional view taken along the line 3—3 of FIG. 2.

The cutting tool 24 is shown in greater detail in FIGS. 2–5. The tool 24 comprises a body 28 having a cylindrical surface with a diameter nearly equal to the internal diameter of the tubing 10. The cutters 26 are hollow, thin-walled and open-ended in a helical direction at the cutting portion to facilitate chip removal, and are secured to body 28, near the trailing portion of the body defined by the direction of tubing movement, at the desired helical angle by fixtures 30 recessed in the body 28, the cutters projecting radially a distance just sufficient to cut through the bases of the tubing valleys. As shown in FIGS. 2 and 4, the cutters 28 are fastened to fixtures 30 by clamps 32, 34 and 36 and by associated fasteners 38, 40 and 42. Fixtures 30 are fastened to body 28 by fasteners 44 and set screws 46 are provided for adjustment of the height of the cutters. The cutters 26 are flat on their tops, minimizing height reduction of the corrugated walls as the drainage openings are cut. Clamp 32 tapers upwardly to the height of the cutters 26 forming a post 48 to engage the openings previously cut and to support the tubing at the openings as the cutters form the next openings as shown best in FIGS. 2 and 4.

The tool 24 is supported on shaft 50. Although the tool may be rotated by a motor (not shown), in the illustrated preferred embodiment, the tool is rotated by frictional engagement with the tubing. The body is rotatably supported by bearings 52 (one shown) on the shaft. A plurality of guide members 54 is equidistantly spaced about the body 28 recessed therein, secured by fasteners 56,58 and biased outwardly by springs 60 between the guides 54 and body 28, best shown in FIGS. 3 and 5. The edge 62 of the guides angled forward, projects radially slightly above the surface of the body to firmly engage the tubing as it moves axially relative to the tool 24. The guides 54 are set at the helical angle desired, between about 14° and 37°, parallel to the cutters 26. The guides 54 have a length spanning a distance equal to a plurality of the valleys of the tubing 10 and thus as the tubing is moved axially, the engagement with guides 54 causes the tool to rotate as the cutters 26 form the drainage openings in the tubing.

Teflon pads 64, spring loaded outwardly (not shown) are mounted ahead of guides 54 about the body circumference to engage the tubing interior ahead of the cutters and a separate stationary metal cylinder 66 is attached to shaft 50 behind tool 24 also engaging the tube interior. The pads 64 and cylinder 66 hold the tubing in a circular shape ahead of and behind the cutters to facilitate accurate cutting, pads 64 having a low coefficient of friction so as not to impede tool rotation. The friction between cylinder 66 and the tubing resists any tendency of the tubing to rotate.

The resultant tubing 10 is best illustrated in FIG. 6. The tubing comprises organic thermoplastic material such as polyethylene or polyvinylchloride. As shown, a plurality of equidistantly spaced drainage openings are located in the base of each valley 14. Each set of openings 16 in one valley is axially offset from the openings 14 of adjacent sets by the tubing material defining the walls and peaks 12 between adjacent valleys 14. Additionally, the openings 16 in each valley 14 each lie on a helical line defined by openings 16 in successive valleys, the helix having an angle to the tubing axis in the range of 14°–37° as above described. The openings in successive valleys are thus also circumferentially offset with tubing material between the adjacent edges of helically adjacent openings and each opening is axially aligned with tubing material over a substantial distance comprising a plurality of peaks and valleys. The helix adjacent that in which one opening lies, crosses an axial line extending from such opening only at such distance.

In a particular embodiment, the tubing has a 3 inch diameter and the valleys are spaced about 7/16 inch apart. Six drainage openings are cut in each valley, spaced equidistantly about the tubing circumference, the openings lying in helical rows. The holes have dimensions of about 1/16 to ⅛ inch by ¼ to 3/16 inch and have collectively an open area of 2.96 inches per linear foot of tubing, i.e., about 2.62% of the tubing surface area. The angle of the helical lines of the openings to the tubing axis is about 14°, describing one revolution in about three feet to one meter. The strength of the tube, as a result, is only about 5% less than an unperforated tube compared to about a 25% weakening of a tube with openings cut in a linear direction.

Advantageously, therefore, the tubing is provided with substantial open area with minimal reduction in strength. Additionally, each valley is provided with a plurality of openings about the circumference of the tube facilitating entry of water on all sides of the tube.

The method and the tool provide a simple economical manner of forming the openings. The tool cutting the openings while they are supported, provides clean, accurate cuts minimizing rough scrap which might form sites for bacterial growth which might tend to obstruct the holes. The frictional rotation of the tool simplifies the design and minimizes cost of the apparatus.

Other embodiments of this invention will occur to those skilled in the art which are within the scope of the following claims.

What is claimed is:

1. Cutting apparatus comprising a cutting tool for internally cutting drainage openings in the bases of valleys in corrugated thermoplastic drainage tubing characterized in that said tool comprises a body rotatably mounted on a shaft, said body adapted to fit within the tubing and having a plurality of radially projecting cutters equidistantly spaced about said body and extending outwardly therefrom, and means for rotating said body which means comprises a plurality of guides spaced apart and extending helically on said body so that said guides project radially to engage the interior of the valleys as the tubing is moved axially thereby rotating said body so that said cutters cut the bases of the valleys.

2. The cutting apparatus claimed in claim 1 further characterized in that said cutters have hollow interiors and are open ended in the helical cutting direction to facilitate chip removal.

3. The cutting apparatus claimed in claim 1 further characterized in that said guides on said body are equidistantly spaced thereabout between said cutters, each guide extending helically at an angle in the range of about 14°–37° to the tool axis and having a length equal to the distance between a plurality of valleys.

4. The cutting apparatus claimed in claim 3 further characterized in that said guides have one helically extending forwardly angled edge projecting radially farther than the other edge to engage the tubing interior.

5. The cutting apparatus claimed in claim 4 further characterized in that biasing means between said body and said guides bias said guides radially outwardly.

6. The cutting apparatus claimed in claim 5 further characterized in that pads of low coefficient of friction material are positioned about said body ahead of said cutters adapted to engage the interior of the tubing to maintain a circular tubing configuration of the tubing ahead of said cutters and further characterized in that a stationary cylindrical member is positioned behind said body adapted to engage the tubing interior to maintain a circular tubing configuration behind said cutters.

7. The cutting apparatus claimed in claim 6 further characterized in that a post is positioned behind each cutter projecting radially outward to the height of the cutter to support the tubing at the opening immediately behind the cutter as the next opening is being cut.

8. The cutting apparatus claimed in claim 7 further characterized in that said guides have one helically extending forwardly angled edge projecting radially farther than the other edge to engage the tubing interior.

9. The cutting apparatus claimed in claim 8 further characterized in that biasing means between said body and said guides bias said guides radially outwardly.

* * * * *